US006733111B2

(12) United States Patent
Yamamoto

(10) Patent No.: US 6,733,111 B2
(45) Date of Patent: May 11, 2004

(54) INKJET HEAD

(75) Inventor: Ryoichi Yamamoto, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/042,298

(22) Filed: Jan. 11, 2002

(65) Prior Publication Data

US 2002/0093552 A1 Jul. 18, 2002

(30) Foreign Application Priority Data

Jan. 12, 2001 (JP) ..... 2001-005443

(51) Int. Cl.[7] ..... B41J 2/14; B41J 2/05
(52) U.S. Cl. ..... 347/47; 347/61
(58) Field of Search ..... 347/20, 44, 47, 347/54, 56, 61, 68–72

(56) References Cited

U.S. PATENT DOCUMENTS 5,870,121 A * 2/1999 Chan ..... 347/59
6,113,221 A * 9/2000 Weber ..... 347/61
6,309,055 B1 * 10/2001 Sakai et al. ..... 347/70

FOREIGN PATENT DOCUMENTS

JP 06-297714 10/1994
JP 09-57964 3/1997

OTHER PUBLICATIONS

Detailed English Translation of provided document JP 09–57964.*
English Abstract of 06–297714.
English Abstract of 09/57964.

* cited by examiner

*Primary Examiner*—Stephen D. Meier
*Assistant Examiner*—An H. Do
(74) *Attorney, Agent, or Firm*—Whitham, Curtis & Christofferson, P.C.

(57) ABSTRACT

An inkjet head is disclosed which has an ink ejection unit disposed on a silicon substrate and a plate including an ink ejection nozzle disposed corresponding to the ink ejection unit. The plate is formed of a film having a linear expansion coefficient from 50% to 200% of a linear expansion coefficient of the silicon substrate. The film is, for example, composed of aramid. The plate is bonded to a partition layer, by which an ink path linking with the ink ejection nozzle is formed, using an ultraviolet curing adhesive.

18 Claims, 2 Drawing Sheets

INKJET HEAD

BACKGROUND OF THE INVENTION

The present invention relates to an inkjet head for performing recording operation by jetting ink droplets onto a recording medium.

Nowadays, inkjet printers for performing recording operation by ejecting ink droplets have come into widespread use. In such circumstances, it is desired to provide an inkjet head having ink ejection nozzles disposed thereon at a high density in a large scale and capable of ejecting ink droplets of a small size so as to output an image and the like with high precision like a photograph by ejecting the ink droplets at a high density.

This inkjet printer employs a piezoelectric system, a heating system, and so on as an ink droplet ejecting system. In the piezoelectric system, an ink droplet is ejected by a piezoelectric device such as a piezoelectric element, a piezoelectric ceramic, and the like the volume of which is varied by a predetermined voltage applied thereto. In the heating system, an ink droplet is ejected using a bubble of ink which is produced by partially boiling ink by a heat generation element which generates heat when a voltage is applied thereto.

In the heating system, there have been proposed various types of inkjet heads which can eject ink droplets from ink ejection nozzles arranged at a high density in a large scale, as disclosed in, for example, JP 6-297714 A.

According to the publication, an inkjet printer is arranged such that heat generation resistors, each of which a heat generation element has and which do not need a protective layer, individual ink paths for ejecting ink droplets from ink ejection nozzles, and ink supply paths for supplying inks to the individual ink paths are formed on a silicon substrate using a semiconductor processing technology as well as an LSI drive circuit is disposed on the same silicon substrate. With this arrangement, it is possible to eject ink through the ink ejection nozzles arranged at the high density in the large-scale.

In particular, when the ink is ejected through the ink ejection nozzles arranged at a high density in a large-scale, it is desired to form the shape of ink ejection nozzles with a high accuracy so that ink droplets can be ejected in desired directions accurately.

However, when the inkjet head is driven for a long time, it is heated by the heat generated by the heat generation resistors. As a result, there is a possibility that ink droplets are ejected unstably and that the directions in which they jet are made also unstable.

When ink droplets are ejected from ink ejection nozzles by, for example, the expansion of bubbles in ink which have been boiled by the heat generated by the heat generation resistors, a plate including the ink ejection nozzles is bent or warped by being excessively heated. As a result, the shape of the ink ejection nozzles is deformed, which makes it impossible for ink droplets to jet in desired directions and makes it impossible for ink droplets to jet at the worst because the plate through which the ink ejection nozzles are formed is exfoliated.

In the inkjet head, a partition layer, by which individual ink paths and ink supply paths are formed, is disposed on a silicon substrate, and the plate, through which the ink ejection nozzles are formed in correspondence to the ink individual paths, is disposed on the partition layer. In this arrangement, the partition layer is bonded to the plate at a high solidifying temperature to improve a production efficiency by shortening a solidifying time. Accordingly, there is a possibility that the plate is bent or warped as well as the shape of the ink ejection nozzles is deformed by the high solidifying temperature, which makes it difficult to obtain an inkjet head having ink ejection nozzles formed in a desired shape, and thereby the yield of the inkjet head is reduced.

These problems arise not only in the heating system using the heat generation element but also in the piezoelectric system using the piezoelectric device such as the piezoelectric element, and the like.

In contrast, JP 9-57964 A proposes to form a nozzle plate, which is joined to an actuator member composed of PZT, of aramid resin having a linear expansion coefficient similar to that of lead zirconate titanate (PZT) in an inkjet head employing a piezoelectric system. However, since the actuator member is joined to the nozzle plate using a heat curing type adhesive in the publication, bending and warping are caused to the nozzle plate, through which nozzles are arranged at a high density, in such a degree as to deform the shape of the nozzles by the difference between the linear expansion coefficients of the actuator member and the nozzle plate. Moreover, the heating type curing adhesive, which has fluidity and is interposed between the nozzle plate and the actuator member, flows into grooves, which are formed in the actuator member composed of PZT at a high accuracy, before the adhesive cures. Thus, the adhesive disperses the volumes of the grooves which affect the ejection of ink droplets. Accordingly, a problem also arises in that the ejection speeds and the sizes of ink droplets ejected from the nozzles are dispersed among the nozzles.

SUMMARY OF THE INVENTION

Accordingly, an object of the present invention, which was made to solve the above problems, is to provide an inkjet head suitable for mass-production which has highly integrated ink ejection nozzles disposed at a high density, can eject ink droplets stably even if the inkjet head is driven for a long time, and further does not reduce a yield in production.

The present invention provides an inkjet head, comprising: an ink ejection unit disposed on a silicon substrate and a plate including an ink ejection nozzle disposed in correspondence to the ink ejection unit so that an ink droplet is ejected from the ink ejection nozzle using the ink ejection unit, wherein the plate is formed of a film composed of aramid.

Then, the plate including the ink ejection nozzle is preferably disposed along a surface of the silicon substrate.

The ink ejection unit preferably comprises a heat generation element for boiling ink and ejecting an ink droplet from the ink ejection nozzle.

The plate preferably has a thickness of 15 $\mu$m or less.

The present invention also provides an inkjet head, comprising: an ink ejection unit disposed on a silicon substrate; and a plate including an ink ejection nozzle disposed in correspondence to the ink ejection unit so that an ink droplet is ejected from the ink ejection nozzle using the ink ejection unit, wherein the plate is formed of a film having a linear expansion coefficient of 50% or more to 200% or less of a linear expansion coefficient of the silicon substrate.

Then, the plate including the ink ejection nozzle is preferably disposed along a surface of the silicon substrate.

The ink ejection unit preferably comprises a heat generation element for boiling ink and ejecting an ink droplet from the ink ejection nozzle.

The plate preferably has a thickness of 15 μm or less.

The present invention still also provides an inkjet head, comprising: an ink ejection unit disposed on a substrate; and a transparent plate including an ink ejection nozzle disposed in correspondence to the ink ejection unit so that an ink droplet is ejected from the ink ejection nozzle using the ink ejection unit, wherein the plate is bonded to an upper layer formed on the substrate using an ultraviolet curing adhesive.

Then, the upper layer is preferably a partition layer, which forms an ink path linking with the ink ejection nozzle.

The ink ejection unit preferably comprises a heat generation element for boiling ink and ejecting an ink droplet from the ink ejection nozzle.

The plate preferably has a thickness of 50 μm or less.

DETAILED DESCRIPTION OF THE INVENTION

An inkjet head of the present invention w ill be described below in detail with reference to a preferable embodiment shown in the accompanying drawings.

Figure 1:
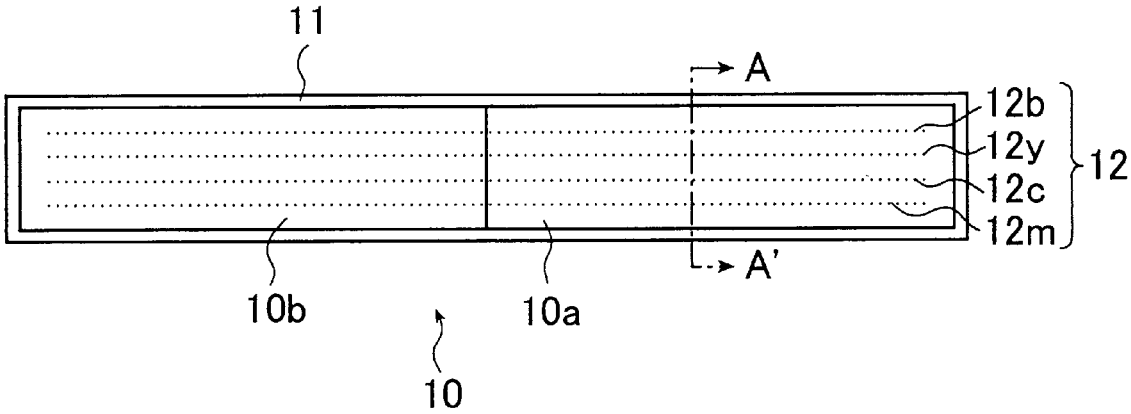
FIG. 1 is a plan view of a preferable embodiment of an inkjet head of the present invention when it is viewed from an ink ejection nozzle surface.
Figure 2:
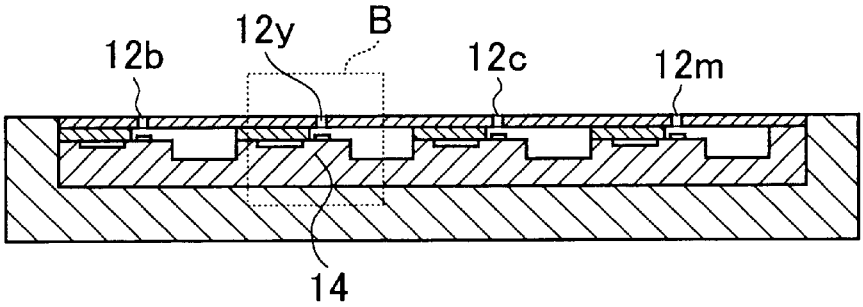
FIG. 2 is a sectional view showing a cross section of the inkjet head taken along the line A-A' shown in FIG. 1.
Figure 3:
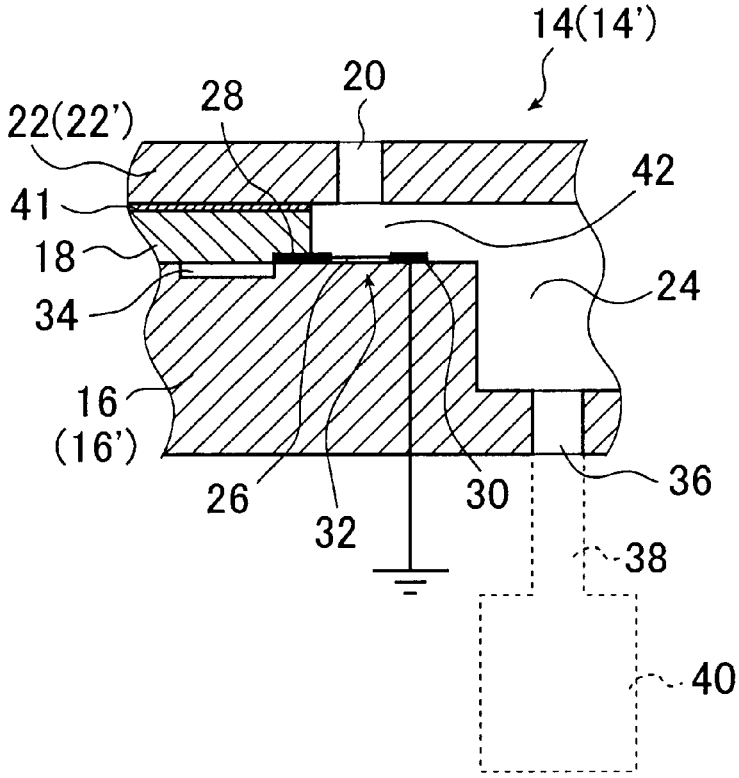
FIG. 3 is an enlarged sectional view of a region B of the inkjet head shown in FIG. 2.

FIG. 1 is a plan view of an inkjet head 10 of the preferable embodiment of the present invention when it is viewed from an ink ejection nozzle surface. FIG. 2 is a sectional view of the inkjet head 10 when it is viewed along the line A-A' thereof shown in FIG. 1. FIG. 3 is an enlarged sectional view of a region B of the inkjet head shown in FIG. 1.

As shown in FIG. 1, the inkjet head 10 is arranged as a line head for an A4 size full color inkjet printer. The inkjet head 10 is constructed such that substrates 10*a* and 10*b*, which are monolithic silicon substrates obtained from a 6 inch wafer and are arranged as described below, are abutted against each other at a center of the line head and mounted on a mounting frame 11.

Disposed on the surface of the inkjet head 10 is a nozzle train 12 composed of a black nozzle train 12*b*, a yellow nozzle train 12*y*, a cyan nozzle train 12*c*, and a magenta nozzle train 12*m* in each of which 6048 ink ejection nozzles are disposed at a density of, for example, 720 dpi (dot/inch). Consequently, the nozzle train 12 includes 24192 ink ejection nozzles in total which are disposed in a length of 210 mm.

As shown in FIG. 3, each ink ejection nozzle of each of the nozzle trains 12*b*, 12*y*, 12*c*, and 12*m* for the respective colors has a similar ink ejection mechanism 14 including an individual ink path 42 and a heat generation element 32. The ink ejection mechanisms 14 will be described below with reference to an ink ejection mechanism 14 corresponding to an ink ejection nozzle of the region B shown in FIG. 2 as an example.

FIG. 3 shows an enlarged sectional structure of the ink ejection mechanism 14 in the region B shown in FIG. 2.

The ink ejection mechanism 14 has such a structure that a partition layer 18 and a plate 22, through which an ink ejection nozzle 20 is defined, are laminated on a silicon substrate 16.

An ink supply path 24 is formed in the silicon substrate 16 by processing, for example etching the substrate 16 in a size of, for example, 150 μm and allocated to each of the nozzle trains 12*b*, 12*y*, 12*c*, and 12*m* of the nozzle train 12. Further, in FIG. 3, a heat generation resistor 26 is formed just below the ink ejection nozzle 20 of the plate 22 by sputtering.

Coupling ink holes 36 are intermittently defined through the bottom surface of the ink supply path 24 and reach the back surface of the silicon substrate 16. The ink supply path 24 links with an ink tank connecting path 38 connected to an ink tank 40, thereby ink is supplied to the ink supply path 24 at all times.

Wiring conductors 28 and 30 are electrically connected to the heat generation resistor 26 for applying a pulse voltage thereto. The wiring conductor 28 is electrically connected to the collector electrode of a driving LSI 34 having a shift resistor circuit and a driver circuit through a through-hole connecting portion (not shown) that traverses an etching resistant layer and a heat insulating layer (both of them are not shown) which are disposed on the silicon substrate 16. Further, the wiring conductor 30 is grounded.

The driving LSI 34 is electrically connected to a total of four lines, that is, to a data line, a clock line, and two power supply lines all of which are wired from a printer controller (not shown). Further, a ground line wired from a side of the substrate 10*a* or 10*b* is connected to the wiring conductor 30 of the heat generation element 32.

The partition layer 18 is disposed on the silicon substrate 16 and forms the individual ink path 42 and the ink supply path 24. The partition layer 18 is formed by bonding a water resistant film resist on the silicon substrate 16 and removing the resist of the portions of the individual ink path 42 and the ink supply path 24. The partition layer 18 covers a part of the wiring conductor 28 as well as the driving LSI 34. While the water resistant film resist is used as the partition layer 18 in the embodiment, polyimide may be used in place of it.

The plate 22, which includes the ink ejection nozzle 20, is formed of a film composed of aramid as aromatic polyamide. Further, the nozzle train 12 having ink ejection nozzles is formed on the plate 22. The ink ejection nozzle 20 is formed in such a manner that the plate 22 is bonded on the partition layer 18 along the silicon substrate 16 using an ultraviolet curing adhesive 41 and then subjected to reactive ion etching using a silicone photo resist having holes defined at portions, where the ink ejection nozzles are formed, as a mask. The photo resist mask is patterned using semiconductor processing technology after it is accurately aligned with the silicon substrate 16 using an alignment pattern exposed thereon, or the like as a reference. Accordingly, the ink ejection nozzle 20 can be formed at a predetermined position accurately and easily above the heat generation element 32 at a high density.

A reason why the film composed of aramid is used for the plate 22 is as described below. That is, the aramid has a linear expansion coefficient of $4\times10^{-6}$ (mm/mm/° C.) which is near to the linear expansion coefficient of $3\times10^{-6}$ (mm/mm/° C.) of the silicon of the silicon substrate 16. Thus, even if the silicon substrate 16 and the plate 22 are brought to high temperature by driving the heat generation element 32 for a long time, the plate 22 is neither bent nor warped with respect to the silicon substrate 16 because they have the approximately same linear expansion coefficients. As a result, the shape of the ink ejection nozzle 20 defined through the plate 22 is not deformed by heat, and even if the heat generation elements 32 are driven for a long time, ink droplets can be stably ejected.

While the film composed of aramid is used in the plate 22 in the above example, the present invention may employ a plate member composed of a material having a linear expansion coefficient of 50% or more to 200% or less (1.5 to $6\times10^{-6}$ mm/Mm/° C.) of the linear expansion coefficient of the silicon of the silicon substrate 16 in place of the aramid. This plate member may be a polymer member or a glass member. Exemplified as the glass member is, for example, borosilicate glass having a linear expansion coefficient of about $3.5\times10^{-6}$ (mm/mm/° C.). When the linear expansion coefficient of the plate member used as the plate 22 is 50% or more to 200% or less of the linear expansion coefficient of the silicon of the silicon substrate 16, the plate 22 can be neither bent nor warped with respect to the silicon substrate 16 even if the heat generation elements 32, which correspond to the respective ink nozzles arranged at a high density in a large scale, are driven for a long time and the silicon substrate 16 and the plate 22 are brought to high temperature.

Further, when the partition layer 18 is composed of an organic material, the bonding property of the plate 22 to the partition layer 18 can be improved.

Moreover, the partition layer 18 and the plate 22 are not heated at a bonding step because they are bonded to each other using the ultraviolet curing adhesive 41 without using a heat curing type adhesive. Thus, the plate 22 is neither warped nor bent by a little difference between the linear expansion coefficients of aramid and silicon. Accordingly, an inkjet head including ink ejection nozzles having a desired shape can be easily obtained, and thereby the yield of the inkjet head can be improved in production as compared with a conventional inkjet head. It is needless to say that even if a heat curing type adhesive is used, the plate 22 is less bent or warped as compared with the conventional inkjet head. Thus, this arrangement is also effective.

It is preferable that the plate 22 arranged as described above have a thickness of 15 $\mu$m or less.

Even if the thickness of the plate 22 is set to 15 $\mu$m or less, the plate 22 can be easily handled as compared with a plate of the same thickness composed of polyimide because aramid has a high Young's modulus and thus high rigidity different from polyimide and the like. In addition, the plate 22 can be effectively bonded to the partition layer 18 without undulation. Further, since the ink ejection nozzles are processed using the reactive ion etching, a processing time can be shortened. Even if the heat generation elements 32 are driven for a long time and the plate 22 is heated thereby, the plate 22 itself is neither warped nor bent by the temperature difference therein when the thickness of the plate 22 is set to 15 $\mu$m or less. This is because that the plate 22 having such a thickness has a small temperature difference between both the sides thereof. Further, the surplus portion of the plate 22, which has been bonded to the partition layer 18 and through which the ink ejection nozzles have been formed by etching during the manufacturing process, can be easily cut off and removed using a diamond blade. The plate 22 is transparent and absorbs a less amount of ultraviolet rays because its thickness is 15 $\mu$m or less. Thus, the plate 22 can be bonded in a relatively short time using the ultraviolet curing adhesive 41. Further, even when the plate 22 is bonded on the alignment pattern exposed on the silicon substrate 16, it can be accurately aligned with the silicon substrate 16 because the plate 22 is transparent when it has the thickness of 15 $\mu$m or less.

Figure 4:
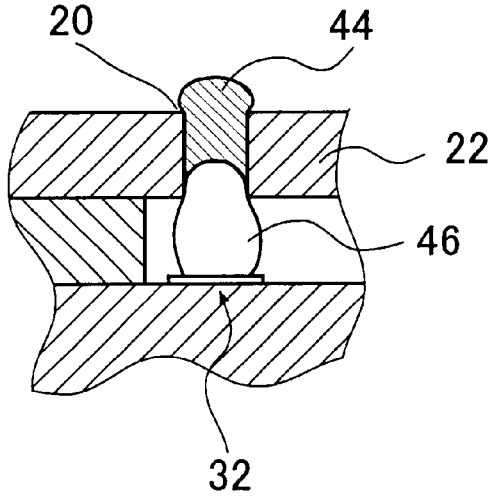
FIG. 4 is a view explaining an ink droplet being ejected from an ink ejection nozzle in the inkjet head shown in FIG. 1.

Further, the length of the ink ejection nozzles 20 can be shortened by setting the thickness of the plate 22 to 15 $\mu$m or less as shown in FIG. 4. Accordingly, the amount of ink, which is positioned above the bubbles 46 produced by the heat generated by the heat generation elements 32 in the ink ejection nozzles 20, can be reduced. As a result, the amount of ink ejected as ink droplets 44 can be reduced, which permits ink droplets having a small size to be ejected when ink is ejected at a high density in a large-scale arrangement.

The above embodiment employs the heat generation element 32 for boiling ink and ejecting an ink droplet from the ink ejection nozzle 20 acting as an ink ejection unit. However, the ink ejection unit in the present invention may employ a piezoelectric system for ejecting an ink droplet by varying the volume of a piezoelectric device such as a piezoelectric element, and the like in accordance with a predetermined voltage.

Further, the embodiment employs a top shooter system, in which the plate 22 having the ink ejection nozzle 20 is disposed along the surface of the silicon substrate 16 and an ink droplet is ejected from the ink ejection nozzle 20 in an approximately vertical direction with respect to the surface of the heat generation resistor 26 of the heat generation element 32 disposed on the silicon substrate 16. However, the present invention may employ a side shooter system in which an ink droplet is ejected in approximately parallel with the surface of the heat generation resistor of the heat generation element.

The ink ejection mechanism 14 is arranged as described above.

In the ink ejection mechanism 14, the heat generation element 32 generates heat in response to a signal supplied from a printer controller (not shown) through a data line and heats and vaporizes ink located on the heat generation resistor 32 of the individual ink path 42 to thereby generate a bubble 46 as shown in FIG. 4. The bubble 46 abruptly expands, pushes upward the ink in the path of the ink ejection nozzle 20, and ejects an ink droplet 44. Thereafter, the bubble 46 communicates with atmosphere as well as is cooled by adiabatic expansion, begins to shrink, and then disappears. With this operation, one ejection of an ink droplet is completed.

When the heat generation element 32 is continuously driven for a long time, heat is gradually accumulated in the silicon substrate 16 and in the plate 22 and the temperatures thereof are increased.

However, the plate 22 is not subjected to strain because the linear expansion coefficient of the silicon substrate 16 is approximately the same as that of the plate 22. As a result, bending and warping are not caused in the plate 22. Moreover, the shape of the ink ejection nozzle 20 is not deformed because the plate 22 is not subjected to strain. Thus, the flying direction of an ink droplet is not varied by the deformation of the ink ejection nozzle 20. Accordingly, even if the heat generation element 32 is driven for a long time, the flying direction of the ink droplet is not varied, and the ink ejecting direction can be maintained in a given state.

Further, even if the plate 22 is brought to high temperature, there is little difference of temperatures between the surfaces of the plate 22 on both the sides thereof, and almost no bending and warping are caused by the temperature difference of the plate 22 itself, and thus the shape of the ink ejection nozzle 20 is not varied.

It should be noted that the present invention may employ an inkjet head that has the same structure as that shown in FIGS. 1 and 2 but that uses the following ink ejection mechanism 14' of the inkjet head in place of the ink ejection mechanism 14 of the inkjet head 10.

That is, the ink ejection mechanism 14' of the inkjet head includes a heat generation element 32 disposed on a substrate 16' and a transparent plate 22' having an ink ejection nozzle 20 disposed in correspondence to the heat generation element 32. The ink ejection mechanism 14' ejects an ink droplet from the ink ejection nozzle 20 using the heat generation element 32. The ink ejection mechanism 14' has a feature that the plate 22' is disposed to the substrate 16', that is, bonded to the partition layer on the substrate 16' using an ultraviolet curing adhesive 14.

Specifically, the ink ejection mechanism 14' has the same structure as that shown in FIG. 3, the silicon substrate 16 is replaced with the silicon substrate 16', the plate 22 composed of aramid is replaced with the plate 22', and the same partition layer 18 is bonded to the plate 22' by the ultraviolet curing adhesive 41. Since the structure of the ink ejection mechanism 14' is the same as that of the ink ejection mechanism 14 except the above structure, the description of the same structure is omitted.

Exemplified as the ultraviolet curing adhesive 41 are resins that cause radical addition polymerization when ultraviolet rays are irradiated thereto such as ester, ether acrylate, urethane acrylate, epoxy acrylate, amino resin acrylate, acrylic resin acrylate, unsaturated polyester, etc., resins that cause cationic polymerization, and thiol/ene additive type resins.

The material of the substrate 16' is not particularly limited, and the substrate 16' may be formed of a material composed of various kinds of compounds such as ceramic, glass, Ga—As, and the like, in addition to silicon.

The plate 22' may be formed of a plate member composed of resins such as polyimide, acryl, PEN (polyether nitrile), etc. and an inorganic material such as $SiO_2$. The plate 22" preferably has a thickness of 50 $\mu$m or less, more preferably has a thickness of 20 $\mu$m or less and still more preferably has a thickness of 15 $\mu$m or less so that ultraviolet rays having a wavelength of about 400 nm passes therethrough at a transmittance of 5% or more and preferably at a transmittance of 10% or more. When the plate 22' is composed of aramid, even if the heat generation element 32 is driven for a long time and the plate 22' is heated thereby, the plate 22' has a small temperature difference between the surfaces of both the sides thereof. As a result, it is preferable that the thickness of the plate 22' is set to 15 $\mu$m or less so that the plate 22' itself is not warped or bent by the temperature difference therein. Further, the plate 22' may be formed of a film material having a linear expansion coefficient of 50% or more to 200% or less of that of the substrate 16'.

In the inkjet head arranged as described above, a layer of an ultraviolet curing adhesive 41 is formed on the surface of the transparent plate 22' where it is bonded to the partition layer 18. After the plate 22' is placed on the partition layer 18, ultraviolet rays are irradiated from the plate 22', and the layer of ultraviolet curing adhesive 41 between the partition layer 18 and the plate 22' is cured using the ultraviolet rays having passed through the plate 22'. Since the plate 22' is bonded as an upper layer of the partition layer 18 using the ultraviolet curing adhesive 41, the partition layer 18 and plate 22' are not brought to high temperature in the boding process, different from a case in which they are bonded using a heat curing type adhesive. Accordingly, the plate 22' is neither warped not bent by the slight difference between the linear expansion coefficients of the plate 22' and the substrate 16'.

Accordingly, an inkjet head having ink ejection nozzles formed in a desired shape can be easily obtained, and thereby a yield can be improved in production as compared with a conventional inkjet head.

Further, it is possible to overcome a disadvantage caused in the in the heat curing type adhesive that when the plate is placed on the partition layer in alignment with the predetermined position of the partition layer, the adhesive in a fluid state flows into the individual ink path 42 and the ink supply path 24 and narrows the regions thereof as well as varies volumes of the individual ink path 42 and the ink supply path 24 of the ink jet ejection nozzle 20 to cause dispersion of the volumes corresponding to ink jet ejection nozzles disposed to the plate 22'.

While the inkjet head of the present invention has been described above in detail, the present invention is by no means limited to the above embodiment and it goes without saying that various improvements and modifications can be made within the range which does not depart from the gist of the present invention.

As described above in detail, the film composed of aramid the linear expansion coefficient of which is approximately the same as that of the silicon substrate is employed as the plate on which the highly integrated ink ejection nozzles are disposed at the high density. Accordingly, even if the inkjet head is driven for a long time, the plate is neither bent nor warped. As a result, ink ejecting directions are not varied and constant quality can be maintained in printing.

Further, the thickness of the film composed of the aramid can be reduced because the film has a high Young's modulus and thus high rigidity. Therefore, a plate without undulation can be easily bonded, and, moreover, the bonding property of the plate with the partition layer composed of the organic material can be improved.

In particular, the thickness of the plate set to 15 $\mu$m can reduce the temperature difference between the surfaces on both the sides thereof. Thus, the plate itself is neither warped nor bent. In the manufacturing process, the surplus portion of the bonded plate can be easily cut off and removed by the diamond blade or the like.

Further, since the transparent film is used as the plate, the plate can be bonded in a relatively short time using the ultraviolet curing adhesive. In addition, since a temperature does not increase in a bonding process different from the case in which the heat curing type adhesive is used, the plate is neither warped nor bent and a yield can be improved in production. Further, the ultraviolet curing adhesive does not disperse the volumes of the individual ink paths and the ink supply paths by being fluidized before it is cured, different from the heat curing type adhesive. Further, since the plate is transparent, even when it is bonded on the silicon substrate at the position of an alignment pattern exposed thereon, it can be accurately aligned with the silicon substrate using a conventional semiconductor process. Furthermore, the length of the paths of the ink ejection nozzles is shortened, which permits ink droplets having a small size to be ejected when they are ejected at a high density in a large scale.

What is claimed is:

1. An inkjet head, comprising:

an ink ejection unit disposed on a silicon substrate; and a plate including an ink ejection nozzle disposed in correspondence to the ink ejection unit so that an ink droplet is ejected from the ink ejection nozzle using the ink ejection unit, wherein the plate is formed of a film composed of aramid and wherein the plate is bonded to an upper layer formed on the substrate using an ultraviolet curing adhesive.

2. The inkjet head according to claim 1, wherein the plate including the ink ejection nozzle is disposed along a surface of the silicon substrate.

3. The inkjet head according to claim 1, wherein the ink ejection unit comprises a heat generation element for boiling ink and ejecting the ink droplet from the ink ejection nozzle.

4. The inkjet head according to claim 1, wherein the plate has a thickness of 15 $\mu$m or less.

5. The inkjet head according to claim 1, wherein the upper layer is a partition layer which forms an ink path linking with the ink ejection nozzle.

6. The inkjet head according to claim 1, wherein the plate is formed of a film having a linear expansion coefficient of 50% or more to 200% or less of a linear expansion coefficient of the silicon substrate.

7. An inkjet head, comprising:

an ink ejection unit disposed on a silicon substrate; and a plate including an ink ejection nozzle disposed in correspondence to the ink ejection unit so that an ink droplet is ejected from the ink ejection nozzle using the ink ejection unit, wherein the plate is formed of a film having a linear expansion coefficient of 50% or more to 200% or less of a linear expansion coefficient of the silicon substrate and wherein the plate is bonded to an upper layer formed on the substrate using an ultraviolet curing adhesive.

8. The inkjet head according to claim 7, wherein the plate including the ink ejection nozzle is disposed along a surface of the silicon substrate.

9. The inkjet head according to claim 7, wherein the ink ejection unit comprises a heat generation element for boiling ink and ejecting the ink droplet from the ink ejection nozzle.

10. The inkjet claim 7 wherein the plate has a thickness of 15 $\mu$m or less.

11. The inkjet head according to claim 7, wherein the upper layer is a partition layer which forms an ink path linking with the ink ejection nozzle.

12. An inkjet head, comprising:

an ink ejection unit disposed on a substrate; and a transparent plate including an ink ejection unit so that an ink droplet is ejected from the ink ejection nozzle using the ink ejection unit, wherein the plate is bonded to an upper layer formed on the substrate using ultraviolet curing adhesive.

13. The inkjet head according to claim 12, wherein the upper layer is a partition layer, which forms an ink path linking with the ink ejection nozzle.

14. The inkjet head according to claim 12, wherein the ink ejection unit comprises a heat generation element for boiling ink and ejecting the ink droplet from the ink ejection nozzle.

15. The inkjet head according to claim 12, wherein the plate has a thickness of 50 $\mu$m or less.

16. The inkjet head according to claim 12, wherein the plate is formed of a film composed of aramid.

17. An inkjet head, comprising:

an ink ejection unit disposed on a silicon substrate; and a transparent plate including an ink ejection nozzle disposed in correspondence to the ink ejection unit so that an ink droplet is ejected from the ink ejection nozzle using the ink ejection unit, wherein the plate is formed of a film composed of aramid and bonded to an upper layer formed on the substrate using an ultraviolet curing adhesive.

18. A method for assembling an inkjet head comprising:

positioning a plate over a silicon substrate;

wherein ultraviolet curing adhesive is positioned between the said plate and silicon substrate;

curing said ultraviolet curing adhesive through the plate;

wherein said plate is transparent to ultraviolet light.

* * * * *

UNITED STATES PATENT AND TRADEMARK OFFICE

CERTIFICATE OF CORRECTION

PATENT NO. : 6,733,111 B2
DATED : May 11, 2004
INVENTOR(S) : Yamamoto

It is certified that error appears in the above-identified patent and that said Letters Patent is hereby corrected as shown below:

Column 9,
Line 34, please replace "10. The inkjet claim 7 wherein …" with -- 10. The inkjet head according to claim 7 wherein… --.

Signed and Sealed this

Seventeenth Day of August, 2004

JON W. DUDAS
*Acting Director of the United States Patent and Trademark Office*